US006708628B2

(12) United States Patent
Halavais

(10) Patent No.: US 6,708,628 B2
(45) Date of Patent: Mar. 23, 2004

(54) LOAD BEARING STRUCTURE FOR COMPOSITE ECOLOGICAL SHIPPING PALLET

(75) Inventor: Richard A. Halavais, Santee, CA (US)

(73) Assignee: Conrad Herring, San Diego, CA (US)

( * ) Notice: Subject to any disclaimer, the term of this patent is extended or adjusted under 35 U.S.C. 154(b) by 0 days.

(21) Appl. No.: 09/978,861

(22) Filed: Oct. 16, 2001

(65) Prior Publication Data

US 2003/0070593 A1 Apr. 17, 2003

(51) Int. Cl.[7] ..... B65D 19/00
(52) U.S. Cl. ..... 108/51.11; 108/57.12
(58) Field of Search ..... 108/51.11, 53.1, 108/55.3, 57.12, 57.25, 57.29

(56) References Cited

U.S. PATENT DOCUMENTS

| | | | | |
|---|---|---|---|---|
| 893,703 | A | * | 7/1908 | Butler |
| 1,612,382 | A | | 12/1926 | Lehman |
| 1,812,218 | A | | 6/1931 | Powell |
| 2,123,714 | A | | 7/1938 | Clark |
| 2,455,197 | A | | 10/1948 | Sullivan |
| 2,481,233 | A | * | 9/1949 | Morset |
| 2,570,326 | A | | 10/1951 | De Angelis |
| 3,267,882 | A | * | 8/1966 | Rapson et al. |
| 3,750,598 | A | * | 8/1973 | Campbell et al. |
| 3,861,326 | A | | 1/1975 | Brown |
| 4,051,787 | A | * | 10/1977 | Nishitani et al. |
| 4,159,681 | A | | 7/1979 | Vandament |
| 4,397,246 | A | * | 8/1983 | Ishida et al. |
| 4,415,619 | A | | 11/1983 | Fuglein |
| 4,784,194 | A | * | 11/1988 | Danner |
| 4,977,711 | A | | 12/1990 | Prignitz |
| 5,052,307 | A | | 10/1991 | Morrison |
| 5,105,948 | A | | 4/1992 | Morris et al. |
| 5,170,722 | A | | 12/1992 | Friesner et al. |
| 5,226,372 | A | * | 7/1993 | Frenkel et al. |
| 5,365,859 | A | | 11/1994 | Schrage |
| 5,402,735 | A | | 4/1995 | DeJean |
| 5,417,167 | A | | 5/1995 | Sadr |
| 5,456,189 | A | | 10/1995 | Belle Isle |
| 5,497,709 | A | | 3/1996 | Gonzalez et al. |
| 5,570,643 | A | * | 11/1996 | Werner |
| 5,601,035 | A | | 2/1997 | Herring et al. |
| 5,643,656 | A | * | 7/1997 | Lin |
| 5,816,172 | A | | 10/1998 | Carter |
| D409,814 | S | | 5/1999 | Herring |
| 5,941,179 | A | | 8/1999 | Herring |
| 6,041,719 | A | | 3/2000 | Vidal et al. |
| 6,142,440 | A | | 11/2000 | Gratz et al. |
| 6,234,088 | B1 | | 5/2001 | Bredal et al. |
| 6,361,013 | B1 | | 3/2002 | Smith |
| 6,386,118 | B1 | | 5/2002 | Bendit et al. |
| 6,389,989 | B1 | | 5/2002 | Hagerty |

FOREIGN PATENT DOCUMENTS

| | | | |
|---|---|---|---|
| FR | 2362053 | | 3/1978 |
| JP | 3-116844 | * | 5/1991 |

OTHER PUBLICATIONS

PCT International Search Report dated Aug. 11, 2003, Int. Appn No. PCT/US02/32773.

* cited by examiner

*Primary Examiner*—José V. Chen
(74) *Attorney, Agent, or Firm*—Law Offices of James D. McFarland

(57) ABSTRACT

A shipping pallet offers significant advantage over the prior art, in that it is stronger, lighter, stiffer and more rigid, more economical, and ecologically sound. The pallet for shipping materials includes a deck that has a plurality of arch elements situated adjacent to each other and wherein each of the arch elements is situated such that a load applied to the deck will transmit forces through each of the arch elements and towards adjacent arch elements, such that forces from adjacent arch elements intersect each other at an intersection point. One advantage of this structural design is that the intersecting forces create a countervailing compressive stress to fully or partially offset the forces from the applied load by laterally redirecting the stress inducing forces.

28 Claims, 6 Drawing Sheets

LOAD BEARING STRUCTURE FOR COMPOSITE ECOLOGICAL SHIPPING PALLET

Reference is made to Disclosure Document No. 495799, filed on Jun. 19, 2001.

BACKGROUND OF THE INVENTION

1. Field of the Invention

The present invention is generally related to shipping pallets, and particularly to a load bearing structure for use on the deck of shipping pallets.

2. Description of Related Art

Shipping pallets are used as portable platforms to handle, store and transport, loads consisting of food, beverage, and most every product or product component produced. A pallet is typically made of wood and consists of slats and posts arranged to provide a top surface and open access underneath for a forklift-type device. Bottom slats may also be added to provide for transport on conveyer belts, for use in automated machinery, and to add strength, stiffness and rigidity to the pallet. The world market exceeds 1.5 billion pallets sold annually with the United States alone accounting for half a billion sales.

Present shipping pallets are usually constructed of wood or wood products with numerous associated problems. There are few shipping pallets constructed from alternative materials, but no matter what construction material is used, all present shipping pallets suffer from one or more significant problems, some of which are described herein.

Construction material choice has unintended consequences that significantly impact the end user and the world at large. Wooden pallets are heavy and often present rough and/or broken areas leading to work related injuries such as muscle strains, hernias, splinters or worse, and damage to the product being transported.

From the obvious issues surrounding logging, there are ecological issues now being addressed on a global scale. Wooden pallets play host to a wide variety of entomological pests and, as a consequence, introduce non-native species of destructive pests into foreign ecology systems. This problem has recently been recognized, and numerous countries around the world are enacting regulations to address it. Even more regulatory action is proposed, and international treaties, along with trade barriers against untreated wooden pallets, are already in force. The cost of wooden shipping pallets can only increase dramatically as preventative and safety measures now mandated are enforced.

One preventative action taken is the application of pesticides. Another preventative action is baking the wood material. However, the presence of pesticides introduces the risk of contaminating the product being carried on the shipping pallet and baking the wood increases the cost of the shipping pallet and still doesn't address the issue of subsequent entomological infestation. Baking also increases fire danger because it dries out the wood, and increases the danger of splinters and the inevitable injury to workers using the pallet.

Disposal of wooden shipping pallets is an equally compelling problem. In the United States alone there are some 270 million wooden shipping pallets sent to landfills or burned yearly. Burning wooden pallets contributes to atmospheric pollution. With current and proposed entomological safeguards mandating pesticide treatment, the problem of pallet disposal becomes even more critical. The added factor of pesticide residue leaching into ground water or being released into the atmosphere through combustion exacerbates the problem. There have even been instances of pesticide-treated wood pallets contaminating the product they carry.

It would be a significant advantage to the art of shipping pallets to improve strength, weight, stiffness and rigidity, cost, design, versatility, production, transport, storage, reuse and recyclability, and ecological acceptability. Prior art amply demonstrates the attention inventors have paid to at least a few of these issues. U.S. Pat. Nos. 5,170,722; 5,365,859; 5,402,735; 5,417,167; 5,456,189; 5,497,709; 5,601,035; and 5,941,179 disclose various designs for prior art pallets.

U.S. Pat. No. 5,417,167 describes a modular plastic pallet design but falls short of the present invention in that the "deck boards" attachment method optionally requires added fasteners and reacts badly to the imposition of a unit load by loosening their grip or attachment to the "stringers." It also describes a design that is decidedly weaker than the present invention and displays a lack of planar stiffness and rigidity that is overcome by the present invention.

U.S. Pat. No. 5,941,179 describes a modular plastic pallet design comprising two basic components that may be assembled into a variety of different pallet configurations to meet specific user needs. The runner to slat attachment means is weak, and the stiffness and rigidity of the design is less than that of the present invention. As with U.S. Pat. No. 5,417,167, this design is amenable to manufacture from a variety of raw materials, including thermoplastics, to eliminate the problem of wood pest hosting.

BRIEF SUMMARY OF THE INVENTION

The present invention adds a number of novel and unique features to the shipping pallet art. For example, utilizing the present invention, shipping pallets can be manufactured mostly from recyclable materials. They can be manufactured from materials that do not support entomological infestation and that can be fire retarding. Structural load bearing characteristics of shipping pallets are enhanced through the utilization of an internal or exoskeleton of a high strength, lightweight material. Durability and impact resistance of the entire pallet structure is enhanced with the use of a suitable inner and/or outer form of a more ductile material. The shipping pallet is built as a compound structure so as to take advantage of varying shapes, sizes, materials and component arrangements to enhance strength, stiffness and rigidity, weight, entomological infestation resistance, fire resistance, and other physical characteristics. The composite design is suitable for any size or configuration of shipping pallet. It is stronger, lighter and more rigid than present shipping pallets. It is reusable for many service cycles, and then it is recyclable at the end of its useful life.

The structure disclosed herein features a combination of design elements that utilize the most effective geometric shapes to increase strength and reduce weight. It allows manufacture from a multitude of potential materials and even allows combinations of different materials within the same component so as to enhance desirable features. With the above stated improvements, the pallet disclosed herein satisfies a need in the marketplace and advances world commerce and preservation of the ecology.

In one embodiment, a load bearing structure includes arch elements placed adjacent to each other wherein tensile stresses, induced by a bending moment imposed upon on the structure from an applied load, are canceled or partially canceled by virtue of the arch elements' direct or indirect interference with adjacent elements, which places the material of construction into compressive stress and creates an offsetting or partially offsetting compressive force within and between the elements.

In another embodiment, a load bearing structure is comprised of a plurality of arch elements rotated through some finite angle arranged so as to directly or indirectly contact adjacent like elements of some finite angle in order to place the material of construction into compressive stress canceling or partially canceling tensile stresses induced by a bending moment imposed upon the structure by an applied load.

In some embodiments, a plurality of the structural elements are extended longitudinally or laterally, or both, to create a large weight bearing surface area. In some embodiments, the arch elements are rotated through a lesser angle than 360°.

In one embodiment, the arch elements are oriented perpendicular to the imposed load. In another embodiment, the arch elements are oriented parallel to the imposed load. In yet another embodiment, the arch elements are oriented other than parallel or perpendicular to the imposed load. In yet another embodiment, the arch elements are oriented randomly in relation to the imposed load.

BRIEF DESCRIPTION OF THE DRAWINGS

For a more complete understanding of this invention, reference is now made to the following detailed description of the embodiments as illustrated in the accompanying drawings, wherein.

DETAILED DESCRIPTION

This invention is described in the following description with reference to the figures, in which like numbers represent the same or similar elements.

Overview

Figure 1A:
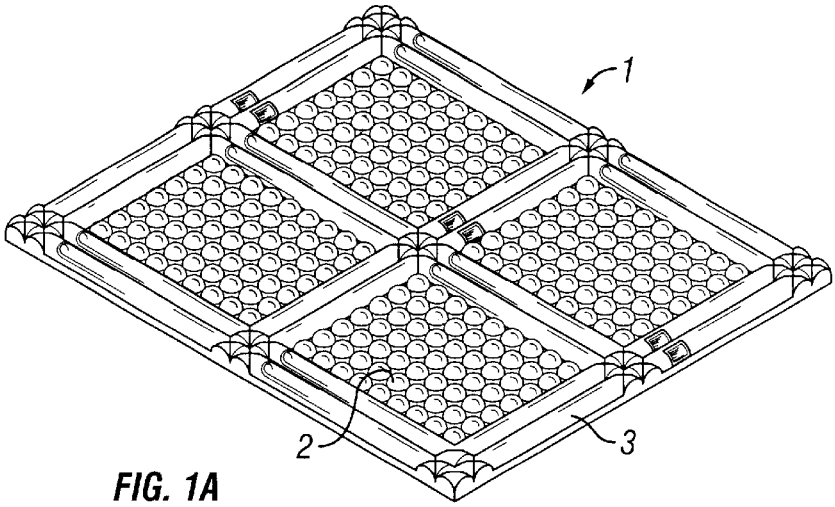
FIG. 1A is a perspective view of a structural skeleton in one embodiment.
Figure 1B:
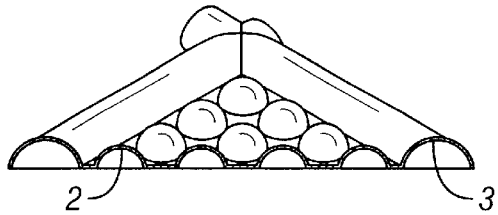
FIG. 1B is an exploded view of a portion of the structural skeleton of FIG. 1A.
Figure 1C:
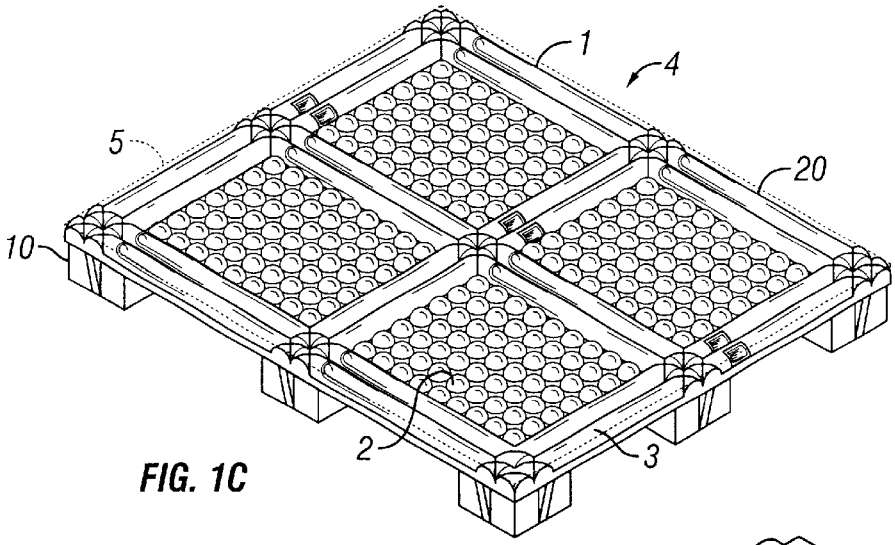
FIG. 1C is a perspective view of a structural skeleton incorporated into a shipping pallet in one embodiment.
Figure 1D:
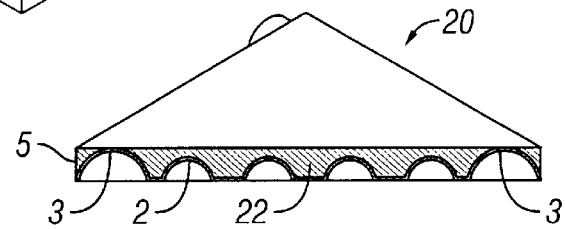
FIG. 1D is an exploded view of a portion of a structural skeleton with filler material in one embodiment.
Figure 1E:
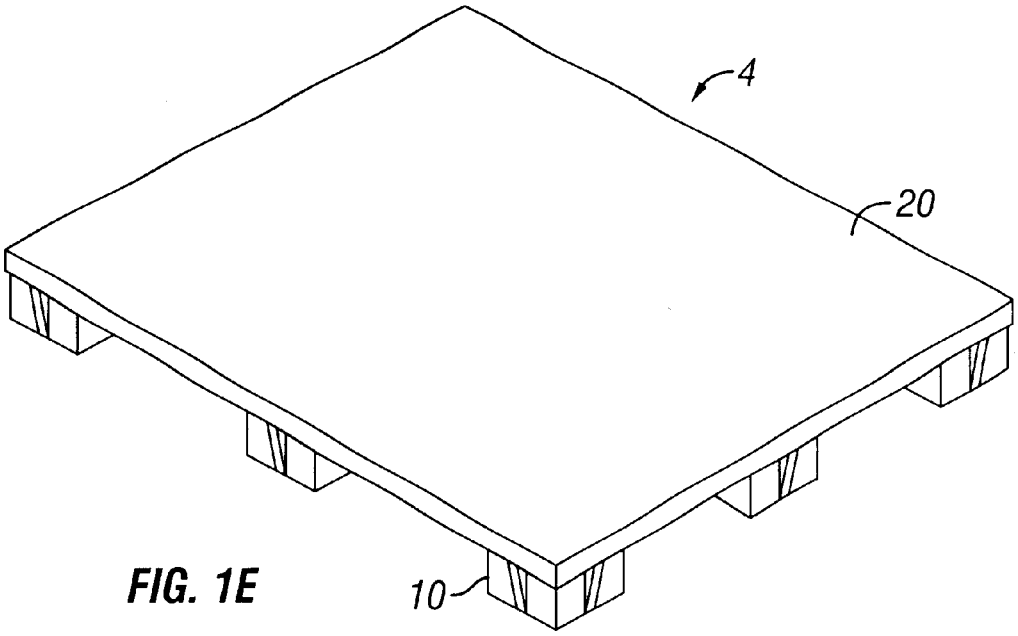
FIG. 1E is a perspective view of one embodiment of the shipping pallet that has a structural skeleton contained within.

FIGS. 1A through 1E illustrate a preferred embodiment of the present invention. In FIG. 1A, structural skeleton 1, which may be internal or external to the product it enhances, includes a plurality of hemispherical elements 2 whose function will be elsewhere fully explained, and a plurality of tubular or semi-tubular terminators 3 whose function will be elsewhere fully explained. FIG. 1B is the exploded upper right hand corner of a portion of FIG. 1A. In FIG. 1B hemispherical elements 2 and a portion of one of the tubular terminators 3 are shown in greater detail. FIG. 1C shows the structural skeleton 1 incorporated into a casing 5, shown transparent for clarity, to provide a form factor to the enhanced product, which in this illustration is a shipping pallet 4 that has a deck 20 and legs or posts 10. FIG. 1D is an exploded view of a portion of a structural skeleton that shows how a fill material 22 is used to provide form factor to the end product by encasing the structural skeleton 1 to form the deck 20. FIG. 1D includes cross-sectional views of hemispherical elements 2 and terminators 3 to reveal their details. FIG. 1E is the completed end product shipping pallet 4 with the deck 20 that has a structural skeleton contained within, and legs 10 connected thereto.

Figure 2A:
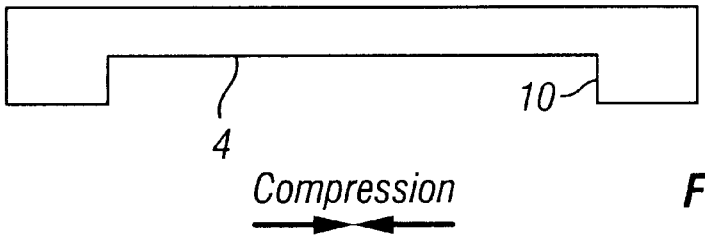
FIG. 2A is a side view that shows a representative pallet deck not under load.
Figure 2B:
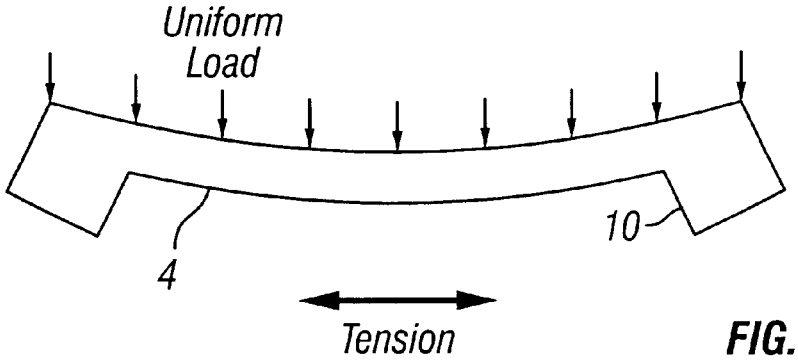
FIG. 2B is a side view that shows a representative pallet deck under load, illustrating tension caused by bending.

FIG. 2A illustrates the pallet deck 4 as a representative beam that is supported on posts or legs 10, and provides background information for purposes of further describing the advantages of the present invention. FIG. 2B illustrates the pallet deck of FIG. 2A wherein the representative beam 4 is loaded on the top with a uniform load and is deflecting downward. This loading places the upper fibers of the beam into compression and the lower fibers of the beam into tension. Materials exhibit better physical properties in compression than in tension, so the failure mode for a typical beam is to rupture in tension beginning at the lower fibers.

Figure 3A:
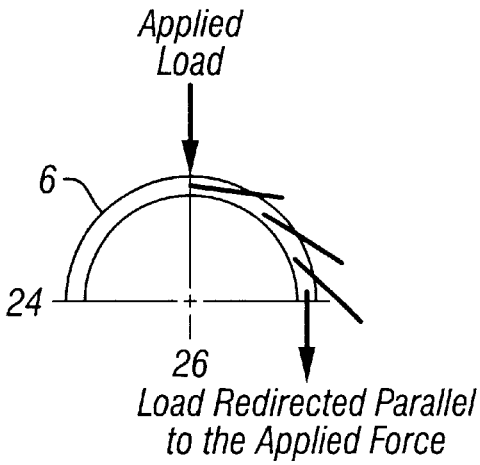
FIG. 3A is cross-section of a full arch element.

FIG. 3A shows a full arch 6 in one embodiment defining horizontal and vertical centerlines 24, 26, respectively. A full arch transmits applied force parallel to the force, displacing the force to the outermost section of the arch. As shown in FIG. 3A, a load that is applied to the top of the full arch 6 will be redirected parallel to the applied force of the load.

Figure 3B:
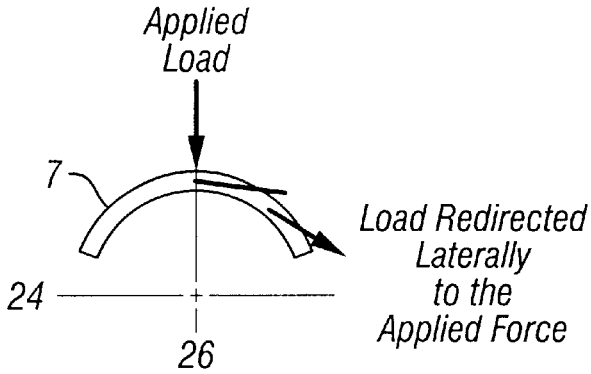
FIG. 3B is a cross-section of a partial arch element.

FIG. 3B shows an arch 7 in one embodiment of the present invention, for ease of reference the arch 7 is hereinafter referred to as a partial arch. A partial arch is an arch that is terminated short of the centerline 24 and which transmits an applied force at some non-zero angle to the force, depending upon the geometry of the arch. As shown in FIG. 3B, a load that is applied to the top of the partial arch 7 will be redirected laterally to the applied force of the load.

Figure 4A:
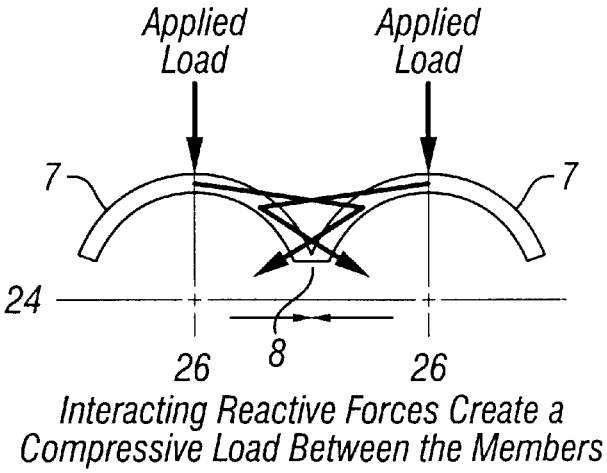
FIG. 4A is a cross-section of adjacent arch elements in one embodiment.
Figure 4B:
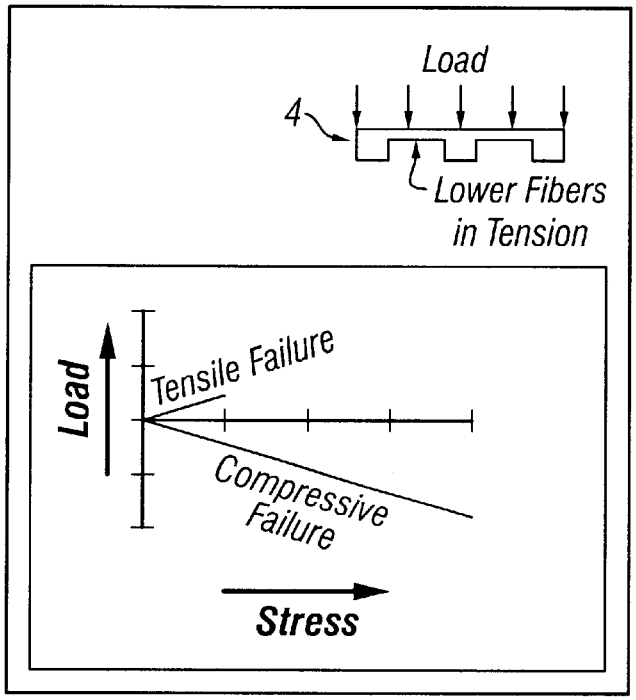
FIG. 4B is a graph showing load versus stress of a load on a pallet deck to show failure of tensile versus compressive stress.
Figure 4C:
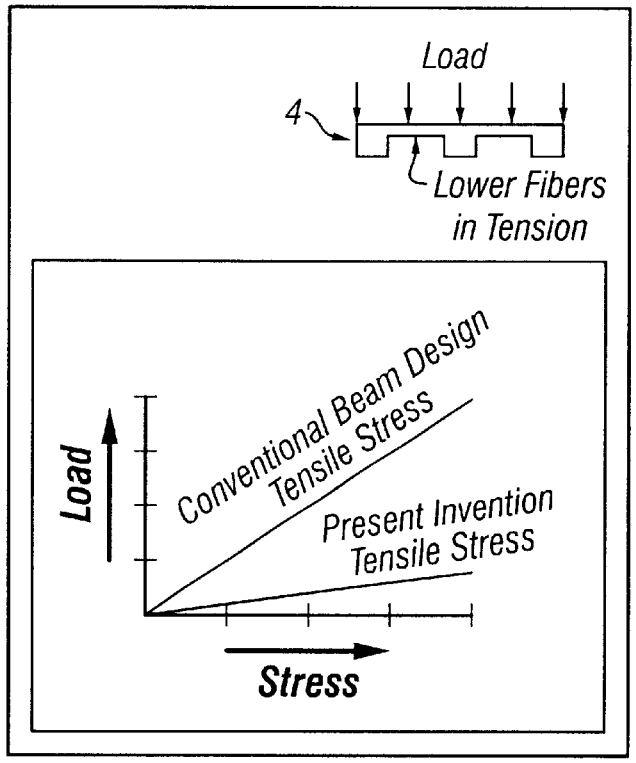
FIG. 4C is a graph showing load versus stress of a load on a prior art pallet versus the load on the pallet in one embodiment of the present invention.

FIG. 4A shows partial arch elements 7 in one embodiment, in contact at the outer edges. A force that is applied to these arches is transmitted through the arches to the contact point 8, thereby creating a compressive force at the contact point. FIG. 4B shows that the probable failure mode is in tension in the lower fibers of the beam or pallet deck 4 when a load is applied to the deck. FIG. 4C shows how the present invention creates a countervailing compressive stress in the lower fibers of the beam or pallet deck 4 to fully or partially offset the tensile stresses created by the bending moment and by redirecting stress inducing forces laterally to be absorbed by the edge tubular and/or semi-tubular supports 3, as shown in FIG. 1A.

Figure 5:
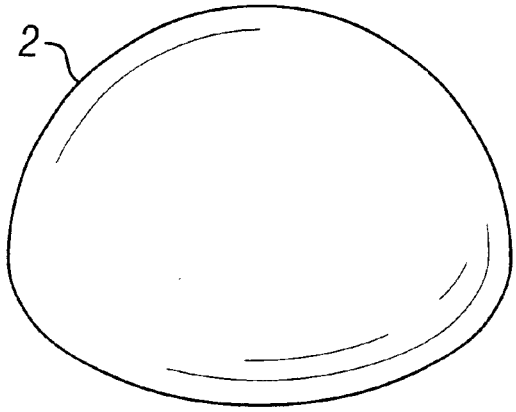
FIG. 5 is a perspective view of one embodiment of an arch element.

FIG. 5 shows the hemispherical element 2 in one embodiment. A hemisphere is comprised of an infinite number of arches rotated in infinitesimally small increments through a full 360°. In some embodiments, the arch elements are rotated through a lesser angle than 360°.

Figure 6:
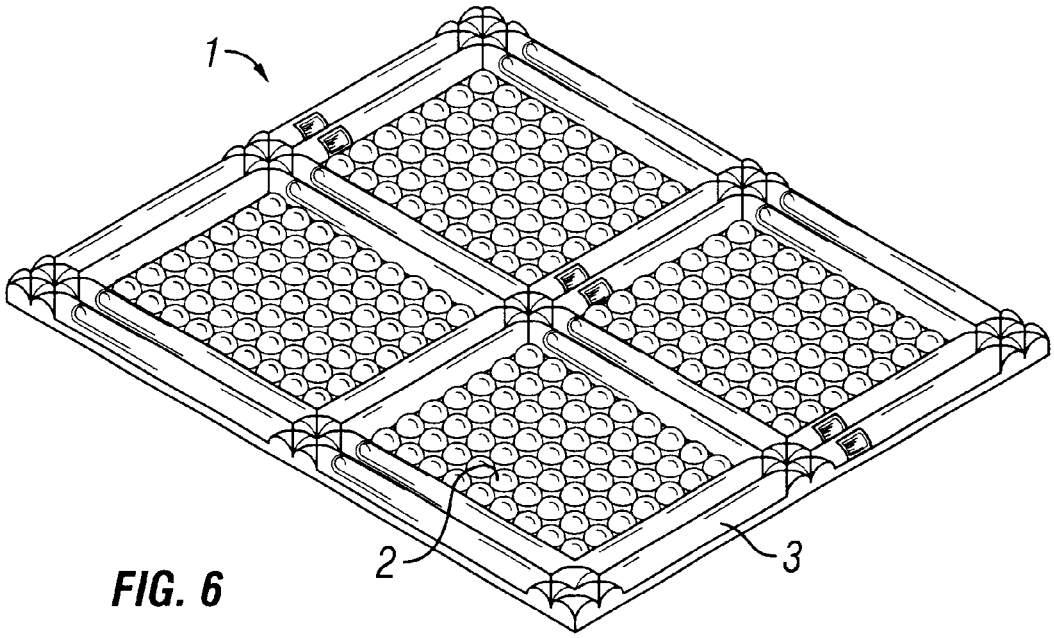
FIG. 6 is a perspective view of one embodiment of the pallet deck.

FIG. 6 shows the structural skeleton 1 of a pallet deck in one embodiment of the present invention wherein a plurality of the hemispherical elements 2 are imposed upon a base material of suitable mechanical properties such as to provide a force transfer matrix that is placed in compression by the reaction of the load transmitted by direct or indirect contact between the hemispherical elements 2. The force is hence transmitted to the plurality of tubular and/or semi-tubular sections 3 arranged so as to absorb stresses and transmit such stresses to the legs or posts.

Figure 7:
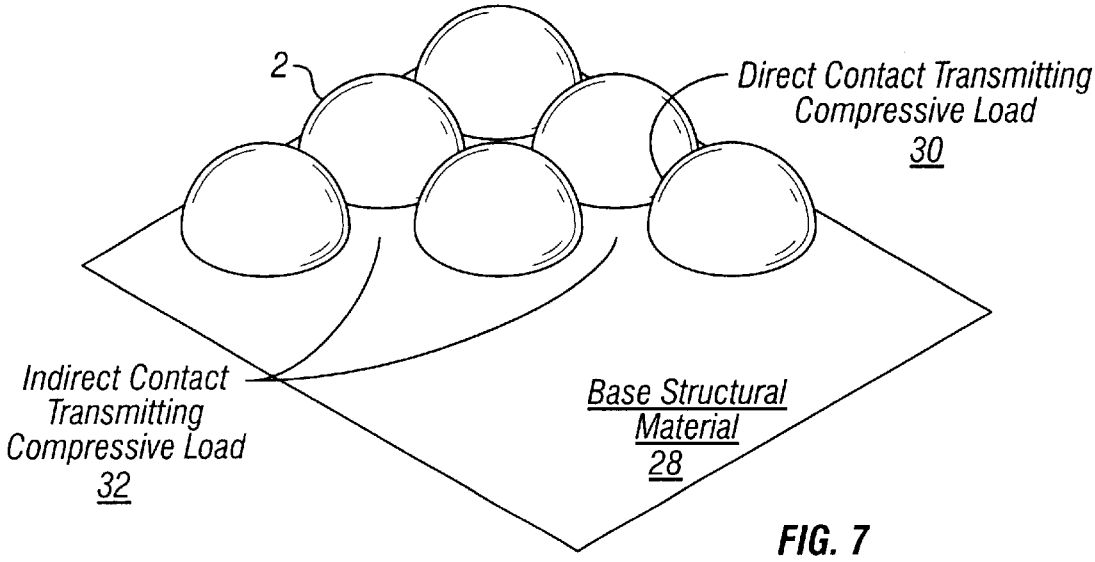
FIG. 7 is a portion of a plurality of arch elements of FIG. 5 imposed upon a structural material indicating direct and indirect contact points between the hemispherical elements.

FIG. 7 shows a portion of the plurality of hemispherical elements 2 imposed upon a suitable base structural material 28 and the direct contact points 30 and indirect contact points 32 between the hemispherical elements 2. The direct and indirect contact points of hemispherical elements 2 transmit compressive load therebetween.

Figure 8:
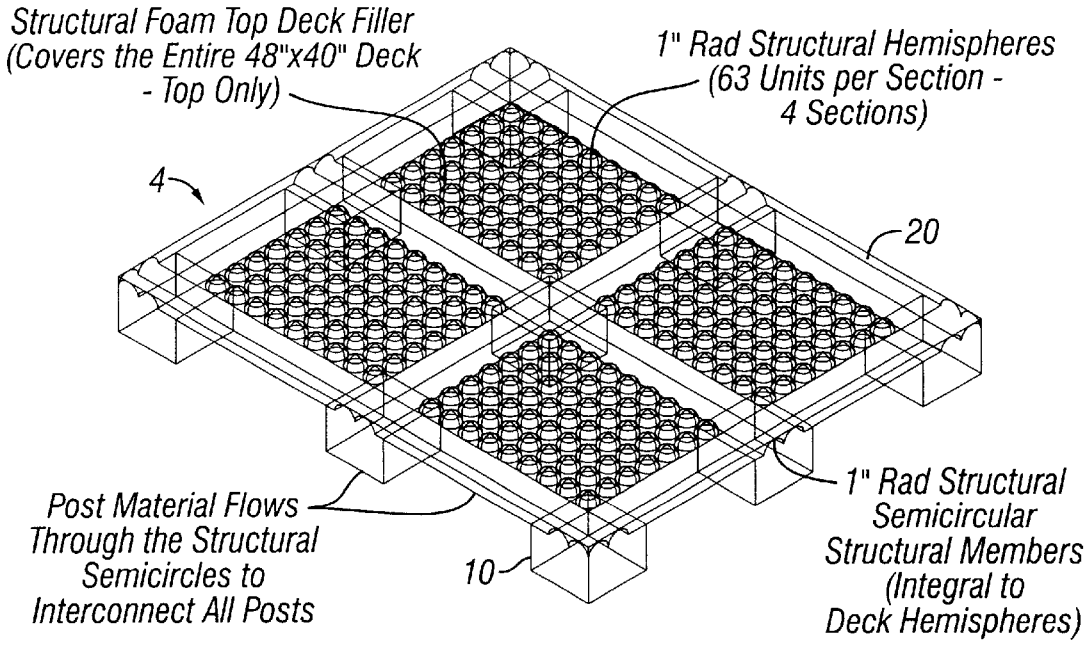
FIG. 8 is one embodiment of a standard size pallet.

FIG. 8 shows a preferred embodiment of the present invention for a standard size pallet 4, which in one embodiment is approximately 48.0 inches by 40.0 inches. The top deck 20 described above is attached to support legs 10 that provide ground clearance for forklift and/or pallet jack entry.

Description

One issue in pallet design is strength. A pallet must support the weight of the product or products it stores statically when just loaded, and dynamically when the product or products are transported on the pallet assembly. Because a pallet is a planar device, it must also maintain cross-plane integrity, rigidity and stiffness so that opposing corners do not deform or loosen and damage or lose the load. Issues of weight and durability are also important to successful pallet performance as well. Typical general/heavy duty wood alternative shipping pallets presently available weigh 40 to 60 pounds. In addition to excessive weight, these pallets are expensive. It is believed that low weight and low cost can be achieved with the structure described herein, at least in part due to the innovations in a structural member that provides high strength and rigidity with substantially less material.

To this end the present invention employs an internal or exoskeleton comprised of a plurality of hollow arch or circular or semi-circular sections arranged at angles relative to each other such as to provide stiffness and rigidity and structural integrity to the planar surface at a much-reduced weight.

FIG. 1A is a perspective view that shows a structural element 1 designed in accordance with the elements of the present invention. The complete structural element 1 is a skeleton that is to be embedded or partially embedded in a matrix of a material 22 that will provide the form factor of a plastic shipping pallet 4. A plurality of hollow hemispheres 2 are shown, the purpose of which will be later described. A plurality of edge terminators 3 in the form of semi-tubular elements formed integral with the hemispherical elements are shown, the purpose of which will be later described. FIG. 1B is a cut-away expanded view of the upper right hand corner of FIG. 1A showing details of hemispheres 2 and edge terminators 3. FIG. 1C is a perspective view of a completed shipping pallet wherein the upper casing 5 is shown transparent for clarity revealing the structural element 1 embedded into the end product shipping pallet 4. FIG. 1D is an exploded view of the upper right corner of the end product of FIG. 1C showing how the matrix fill material 22 used for form factor encases the upper side of the structural element to form the deck 20. FIG. 1E shows the completed shipping pallet 4.

In FIGS. 1A through 1E, the plurality of hollow domes 2 is one possible embodiment. Other embodiments, such as a lattice configuration, will be immediately obvious to one skilled in the art. The plurality of semi-tubular terminators 3 is where the load carried by the pallet is transferred through the hemispherical elements 2 to the legs or posts 10. Representation of this particular embodiment is one method to implement the means and methods and is in no way meant to limit the claims of the present invention.

FIG. 2A illustrates a conventional post/beam deck type-shipping pallet 4. FIG. 2B shows the conventional post/beam deck type-shipping pallet 4 wherein a bending moment is imposed by virtue of the load or weight of the product being carried. This bending moment creates upper fiber compression and lower fiber tension in the pallet deck or other beam or wall type structural member, in other words weight or force loaded on one side.

FIG. 3A shows a full arch element 6 under an applied load. The forces induced by this load are reacted through the arch and offset to the edges parallel to the applied load. In FIG. 3B the partial arch 7, in one embodiment of the present invention, is terminated short of a full radius, and the load is reacted laterally through the partial arch 7 at an angle relating to the geometry of the section, relative to the applied load.

FIGS. 4A through 4C show how the connection between any of a plurality of arch sections interact to produce a compressive force counteracting the tensile force normally encountered in a loaded beam section, as described above.

FIG. 5 shows the hemisphere 2 in one embodiment of the present invention. A hemisphere is an infinite number of infinitesimally small arches rotated in infinitesimally small increments through a full 360°. The reaction to forces is the same as in the arches of FIG. 4A but the reaction is absorbed and rotated through the full 360°.

FIG. 6 shows the hemispherical elements 2 that react the transmitted forces of the pallet deck to the tubular or semi-tubular elements 3. Tubular or semi-tubular elements 3 are arch sections within the scope of the present invention but other geometric shapes are possible, as will be immediately obvious to one skilled in the art and are not by reference excluded.

FIG. 7 shows several of the plurality of hollow hemispherical elements 2 impressed into a sheet of suitable base structural material to form the internal skeleton 1 of the pallet 4. The interaction of the force redirection is shown for both direct hemisphere four-point edge contact 30 and for indirect contact 32 through the structural material 28 in which the hemispheres are impressed. The tubular or semi-tubular edge elements may also be impressed into the structural material to complete the stress transfer.

FIG. 8 shows a typical pallet 4 with the internal skeleton 1 of the present invention and the addition of lightweight filler material to add necessary form to the product. In one embodiment, the structural foam top deck filler covers an entire approximately 48.0 inch×40.0 inch deck (top only).

Structural hemispheres 2, which have an approximately 1.0 inch radius, comprise approximately 63 units per section (4 sections), and the approximately 1.0 inch radius structural semicircular structural members 3 are integral with the deck hemispheres 2. As shown in FIG. 8, post material flows through the structural semi-circles to interconnect all of the posts. In one such embodiment the dimensions are approximately as follows: the length of the deck is 48.0 inches, the width of the deck is 40.0 inches, the thickness of the deck is 1.0 inch, the height of the legs or posts is 1.2 inches, the length and width of the legs or posts is 6.0 inches.

The present invention lends itself to production using a wide variety of materials and manufacturing processes. The essential components may be made of the same or a composite of different materials and may incorporate more than one material within the manufacture of any one component. Component pieces may be produced in plastic type materials, metallic elements, or any combination thereof or from any material having sufficient strength and rigidity to prove acceptable in the application.

The load bearing structure for a typical shipping pallet illustrated and described herein is the preferred embodiment. However, the preferred embodiment is but one of many applications for the technology of the present invention that are immediately obvious to one skilled in the art. Nothing herein is meant in any way to limit the present invention or the technology of the present invention to shipping pallets or any other application for this technology. All such other implementations and applications, not shown here for simplicity, are deemed to be within the scope of the present invention, and are to be limited only by the claims appended hereto.

What is claimed is:

1. A pallet for shipping materials comprising:

a rigid deck that has a plurality of adjacent arch elements arranged in an intersecting configuration including a plurality of adjacent arch elements arranged in a configuration in which a downward force from the applied load of the shipping materials is translated laterally by said adjacent arches to provide lateral compressive forces between said adjacent arches to strengthen said deck; and a plurality of legs extending from said lower surface of said deck for supporting said deck.

2. The pallet of claim 1, wherein each of said plurality of arch elements defines a partial arch.

3. The pallet of claim 1, wherein each of said plurality of arch elements comprises a full arch.

4. The pallet of claim 1, wherein each of said plurality of arch elements defines a horizontal centerline and wherein each of said arch elements is situated such that said compressive forces from adjacent arch elements intersect each other at an intersection point located above said horizontal centerline.

5. The pallet of claim 1, wherein each of said plurality of arch elements defines a horizontal centerline and wherein each of said arch elements is situated such that said compressive forces from adjacent arch elements intersect each other at an intersection point located approximately along said horizontal centerline and between said adjacent arch elements.

6. The pallet of claim 1, wherein said plurality of arch elements comprise a plurality of rows of said arch elements, said plurality of rows extending in at least two directions that cross each other at a non-zero angle.

7. The pallet of claim 6, wherein said plurality of rows extend diagonally to form an approximately lattice pattern.

8. The pallet of claim 6, wherein said plurality of rows extend longitudinally and laterally to form an approximately 90 degree-crossing pattern.

9. The pallet of claim 1, wherein each of said plurality of arch elements comprises a finite number of arches rotated through a lesser angle than 360°.

10. The pallet of claim 1, wherein each of said plurality of arch elements comprises an infinite number of arches rotated through 360°.

11. The pallet of claim 1, wherein each of said plurality of arch elements comprises a hemispherical geometry.

12. The pallet of claim 1, wherein each of said plurality of arch elements comprises a non-hemispherical geometry.

13. The pallet of claim 1, further comprising a plurality of legs for supporting said deck.

14. The pallet of claim 13, wherein said plurality of legs are situated to receive one of a forklift and a pallet jack entry.

15. A pallet for shipping materials comprising a rigid deck that has an upper and a lower surface and a plurality of arch elements configured with their top peaks proximate to the upper surface, said deck including a plurality of adjacent arch elements situated in an intersecting configuration such that downward forces from a load applied to the upper surface of said deck are distributed from the top of said arches downwardly through each of said arch elements and laterally towards adjacent arch elements, such that forces from adjacent arch elements intersect each other to provide lateral compressive forces to strengthen said deck.

16. The pallet of claim 15, wherein each of said plurality of arch elements comprises a plurality of arches rotated through a non-zero angle.

17. The pallet of claim 16, wherein each of said arch elements comprises a partial arch.

18. The pallet of claim 17, wherein each of said plurality of arch elements defines a horizontal centerline, and wherein said intersection point is located above said horizontal centerline.

19. The pallet of claim 18, wherein each of said arch elements is situated so as to intersect at least one adjacent arch element at said point short of said horizontal centerline.

20. The pallet of claim 1 wherein the downward force from the load induces a bending moment on the deck that imposes tensile stresses on said lower surface, and said lateral compressive forces are created proximate to said lower surface to at least partially offset said tensile stresses, thereby strengthening said deck.

21. The pallet of claim 20 further comprising a plurality of legs extending from said lower surface of said deck.

22. The pallet of claim 1 wherein said deck defines an upper and a lower surface, and the downward force from the load applied to the upper surface induces a bending moment on the deck that imposes tensile stresses on said lower surface, and said lateral compressive forces are created proximate to said lower surface to at least partially offset said tensile stresses, thereby strengthening said deck.

23. A load bearing structure including a deck for supporting a load that applies downward forces that imposes tensile stresses on said deck, said deck comprising a plurality of arch elements situated in an adjacent intersecting configuration to generate compressive forces between adjacent arch elements responsive to an applied load, said compressive forces generated proximate to said tensile stresses to at least partially offset said tensile stresses, thereby strengthening said deck.

24. The load being structure of claim 23 wherein each of said arch elements define a concave shape.

25. The load bearing structure of claim 24 wherein each of said arch elements defines an approximately hemispherical shape.

26. The load bearing structure of claim 23 wherein at least one of said plurality of arch elements is rotated through a finite angle less than 360°.

27. The load bearing structure of claim 23 wherein each of said arches comprises a partial arch.

28. The load bearing structure of claim 23, further comprising a plurality of legs extending from said load bearing structure thereby providing a pallet for shipping materials.

* * * * *